United States Patent [19]

Johnson

[11] Patent Number: 4,688,799

[45] Date of Patent: Aug. 25, 1987

[54] GOLF CLUB

[76] Inventor: Kenneth W. Johnson, 2185 Pinewood Cir., Naples, Fla. 33942

[21] Appl. No.: 806,875

[22] Filed: Dec. 9, 1985

[51] Int. Cl.[4] ..... A63B 53/04

[52] U.S. Cl. ..... 273/174; 273/164; 273/192

[58] Field of Search ..... 273/192, 174, 169, 170, 273/171, 172, 173, 175, 167 A, 164, 193 R, 194 A, 162 R

[56] References Cited

U.S. PATENT DOCUMENTS

| | | | |
|---|---|---|---|
| 193,399 | 8/1962 | McGranaghan | D34/5 |
| 2,057,275 | 11/1933 | McKenna | 273/77 R |
| 2,084,901 | 6/1937 | Eisenberg | 273/192 |
| 2,255,332 | 9/1941 | Russell | 273/77 R |
| 2,300,043 | 10/1942 | Carney | 273/77 R |
| 2,426,274 | 8/1947 | Kramer | 273/7 R |
| 3,049,833 | 8/1962 | Felsch | 46/220 |
| 3,199,873 | 8/1965 | Surratt | 273/163 |
| 3,319,964 | 5/1967 | Steinberg | 273/192 X |
| 3,377,065 | 4/1968 | White | 273/67 R |
| 3,471,155 | 10/1969 | Donaldson | 273/192 X |
| 3,680,868 | 8/1972 | Jacob | 273/174 |
| 4,332,388 | 6/1982 | Crow | 273/172 |
| 4,529,202 | 7/1985 | Jacobson | 273/168 |

FOREIGN PATENT DOCUMENTS

| | | | |
|---|---|---|---|
| 5902 | 3/1894 | United Kingdom | 273/174 |
| 11463 | 5/1902 | United Kingdom | 273/174 |

*Primary Examiner*—George J. Marlo

*Attorney, Agent, or Firm*—Biebel, French & Nauman

[57] ABSTRACT

A system for properly vertically positioning and stabilizing a golf club which may be utilized with either a putter or a driving wood wherein a rotatable circular roller is mounted on either the toe or the heel of the golf club and provides for proper vertical positioning and stabilization of the club face during either the putting or driving stroke with respect to the center of mass of the ball.

4 Claims, 10 Drawing Figures

60
22
66
64
77
85
64
87
84
90
82
75
70
88
87
25
72
74

60
21
22
33
84
70
65
88
62

85
87
70
60
84
74
86
72
22
66
90
81
77
80
85
75
86
82
87
64

GOLF CLUB

BACKGROUND OF THE INVENTION

This invention relates to improved golf clubs, specifically the putter, which is used on the green or putting surface surrounding the hole for the purpose of rolling the golf ball into the hole, and the driving wood (driver), which is used on the golf tee for the purpose of propelling the golf ball in the air toward the green, and more particularly to a system for vertically positioning and stabilizing or controlling the height of a golf club above the ground at the moment of impact with the golf ball.

As most golfers know, two of the most exacting shots that a golfer must make are the initial drive off the tee and the putt on the green. With reference to driving, it is important, among other criteria, that the head of the driver contact the ball at an exact location in order to achieve maximum distance and accuracy. In preparation for the drive, the golf ball is normally placed upon a wooden or plastic tee which elevates the ball above the golf tee surface. The driver head impacts the ball in this elevated position and propels it down the fairway toward the green.

During this stroke, golfers have a tendency to hit either below or above the center of the elevated ball. This may be the result of slight variations in their swing in that they appear to raise or lower the driver head as it approaches the ball prior to impact with the ball or it may result from inconsistent tee placement with respect to locating the ball above the ground surface each time.

If the driver head impacts the elevated ball too far under the ideal contact point, a skied drive will result. If the driver head impacts the ball too far above the ideal contact point, a topped drive will result. Either of these conditions result in decreased distance and accuracy as opposed to a golf swing in which the club head strikes the ball with the ideal contact point on the driver head in horizontal alignment with the center of mass of the ball.

When the golf ball is elevated above the ground on a tee in preparation for driving, it has been observed that after exact vertical positioning of the ball, the best golfers drag the club head along the ground for a distance before elevating it behind the golfer in preparation for the downward driving stroke. It has also been observed that this dragging of the club head along the ground appears to make the golfer automatically pivot, keep his head steady, keep the golf swing on plane, and give the ball as much desired overspin. However, problems arise during the driving stroke down-swing in that sometimes the golfer will tee the ball too high or too low so that upon the club head impacting the ball, even after execution of the correct swing, the "sweet spot" or ideal contact point on the face of the club head does not impact the ball exactly right, this reducing either the accuracy or the distance of the ball or both.

Devices for improving driving woods have been known in the art for quite some time. For example, at least one device has been designed for insuring that as a driver is dragged along the ground, a sound is created, the denoting to a golfer that he is executing the proper method of taking the driving wood back, as is disclosed in U.S. Pat. No. 2,300,043 to Carney. A device for preventing driving woods from digging into the turf is disclosed in U.S. Pat. No. 2,255,332 to Russell.

With reference to putting, it is important, among other criteria, that the putter head or blade impact the golf ball at an exact location in order to achieve proper distance, head control and line accuracy. In preparation for executing a putt, the golfer, due to the construction of most putters currently on the market, is confronted with a vertical positioning problems. Specifically, when the putter is placed proximate the golf ball, the bottom surface of the putter is contacting the green, but the putter is not, with respect to the ideal impact point on the golf ball, properly vertically positioned.

In order to have the "sweet spot" or ideal impact point on the putter face impact the ball in proper alignment with its center of mass, most conventional putters require that the golfer raise the bottom surface of the putter head up off the green, thereby breaking contact with the green surface. With the putter head suspended in air, there is no known way to insure that the ideal impact point of the putter head face and the center mass of the golf ball coincide at impact during the putting stroke except by trial and error. Needless to say, even if the golfer is able to determine the exact vertical height of the putter head face above the putting green surface, it is very difficult, if not impossible, to reproduce this exact vertical position with respect to height above the green at impact with the golf ball on each putting stroke.

The vertical postioning problem in addition to the problems of holding the putter steady and maintaining the club head square, often results in the putter blade wiggling from side to side, twisting from end to end, and/or moving up and down. This condition is sometime referred to as the "yips" and is experienced at times by both young and old, amateur and professionals alike. The "yips" appear to be more prevalent with the pendulum-like putter that, unless rigidly restrained by the golfer's hands and arms, becomes completely unstable, thus resulting in putts that are off target.

During the putting stroke, golfers have a tendency to raise or lower the putter head with respect to the green as the putter head approaches the golf ball just prior to impact with the ball as well as difficulty in holding the putter steady and maintaining a square club face. If the putter face impacts the golf ball too high above the ball's center of mass, the ball tends to dig into the green surface, thus causing it to roll inaccurately across green out of line with the hole. If the putter head impacts the ball too low or digs into the putting surface or green, the ball tends to jump across the green, rolling out of line with the hole. Either of these conditions results in inaccuracy in both distance and putting line to the hole as opposed to when the putting head blade center mass or "sweet spot" impacts the golf ball center mass.

There have been a variety of attempts to increase the putting accuracy of the golfer. One attempt dealing with putting from the fringe area surrounding the putting surface or green is taught in U.S. Pat. No. 4,529,202 to Jacobson. Devices for decreasing the friction between the putter head and the putting surface are taught in U.S. Pat. Nos. 3,680,868 (Jacobs), 2,426,274 (Kramer), and British Pat. No. 11,463 of 1902.

A common drawback to both the putters and driving woods known in the art is that the putters and/or drivers rely solely upon the golfer to position and stabilize either the putter head or the face of the driving wood head at the correct height with respect to the golf ball's center of mass. With respect to putting, proper vertical positioning of the putting head with respect to the center mass of the ball eliminates ground scuffing of the putter head or topping of the ball. Putter vertical stabilization is controlled by only one point of contact, that being between the club and the golfer's hands. With respect to driving woods, proper vertical positioning of the club faces with respect to the center mass of the ball eliminates both skying and topping of the drive and is also contacted by only one point of contact, that being the club and the golfer's hand.

Thus there is a need in the art for a device which, when attached to a putter, produces exact reproducible vertical height positioning of the putter head above the green with respect to the center mass of the golf ball for putting the ball, and for providing a point of contact for the putter with the ground to stabalize the putter and act as a dampener to produce overall putter head stability and a device which when attached to a driving wood provides exact reproducible vertical height positioning of the driving wood head with respect to the center mass of the golf ball elevated on a tee.

It is therefore an object of this invention to provide a device which can be utilized with either a putter or a driving wood to position both golf clubs vertically with respect to the ball in order to control the impact height as well as dampen and stabilize the putter; to provide an improved putter which produces exact reproducible vertical positioning of the putter head above the putter surface with respect to the center mass of the golf ball; to provide a device which can be utilized with the vast majority of the putters currently on the market for reproducing the vertical height of the putter head with respect to the golf ball above the putting surface; and to provide a device which effects exact reproducible vertical positioning of a driving wood head above the surface of the ground with respect to the center mass of a teed up golf ball.

Other objects and advantages of the invention will be apparent from the following description, the accompanying drawings and the appended claims.

DETAILED DESCRIPTION OF THE PREFERRED EMBODIMENT

Figure 1:
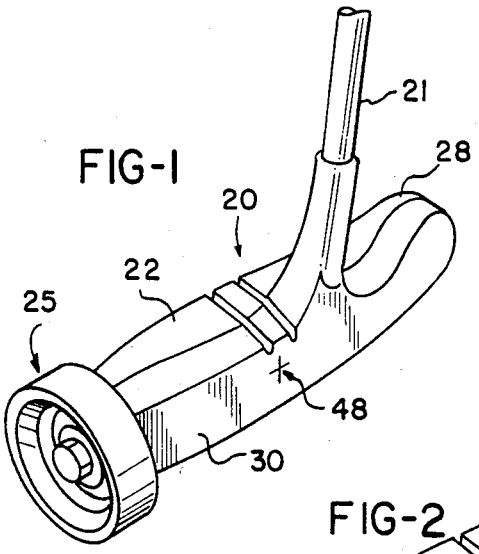
FIG. 1 is a perspective view of a golf putter having vertical stabilization means in accordance with the present invention connected to the toe thereof.
Figure 2:
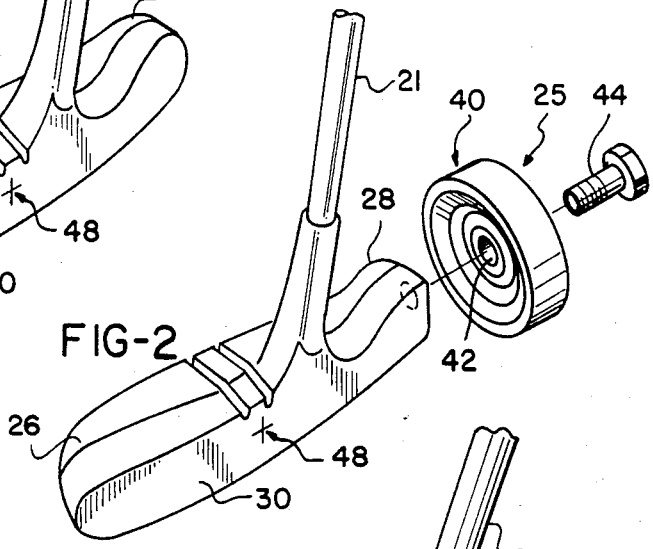
FIG. 2 is an exploded perspective view of a putter having the stabilization means connected to the heel thereof.

As shown in FIG. 1, a putter 20 comprises a shaft 21 and a head 22 of conventional shape provided with vertical positioning and stabilizing means 25, in accordance with the present invention, connected to the toe 26 thereof. The putter head 22 may be made of steel or aluminum in the same manner in which putters have been made for may years, or it may be made of plastic material recently utilized for the manufacture of putters. The exact type of material employed in the putter head 26 is not critical, nor is its exact shape. Although it is shown in FIGS. 1–5 as being relatively thick, the present invention may be utilized with nearly all putters currently available in the marketplace.

The putter head 22 has a toe 26, a heel 28 and a face 30 for impacting a golf ball 33. Mounted at the heel 28 of the putter head 22 is a vertical positioning and stabilization means 25 connected to the head 22 so that the head 26 is maintained at a predetermined height above a "green" or other putting surface 35. In the embodiment illustrated in FIGS. 1–5, the vertical positioning and stabilization means 25 consists of a circular roller 40 having bearing means 42 rotatably mounted on an axle member 44. The axle 44 is shown as a bolt connected to the heel 28 of the putter head 22 by drilling and tapping the putter head.

Figure 4:
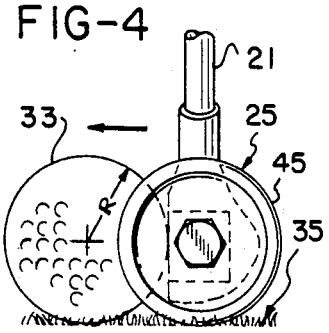
FIG. 4 is an end view illustrating the relationship between the face of the putter head and the golf ball at the moment of impact of the putter head with the ball.

The diameter of the circular roller 40 and the location of the connection point of the member 44 to the putter head are critical to the practice of the present invention. Specifically, as shown in FIG. 4, these values should be such that when the outer periphery 45 of the roller rests on the putting surface 35, the center of mass, and the corresponding "sweet spot" 48 on the face of the putter head, will be aligned as accurately as possible with the center of mass of the golf ball 33.

Figure 3:
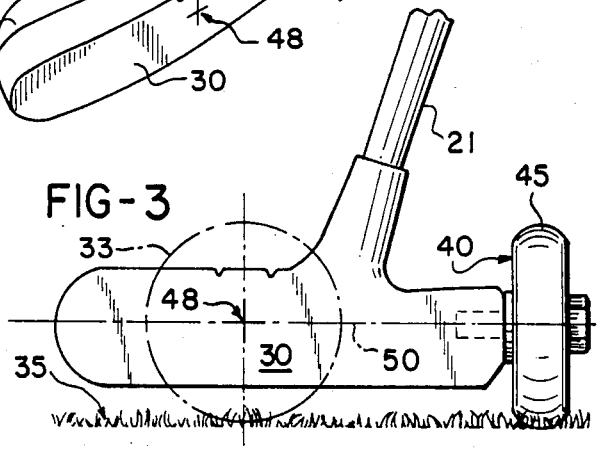
FIG. 3 is a front view of illustrating the relationship of the putter of FIG. 2 and the ball at the moment of putting inpact.

An important objective of the present invention is realized by aligning the roller axle with the imaginary plane or horizontal axis 50 between the toe 26 and the heel 28 of the putter head that passes through the "sweet spot" 48 on the face of the putter head, and then selecting a roller 40 of a radius which coincides with the radius of the golf ball 33. Specifically, as shown in FIGS. 3 and 4, the radius of the roller 40 is selected such that an extension of its axis of rotation provided by the axle 44 is in the same horizontal plane with the "sweet spot" 48.

An alternative embodiment of putter 20 utilizing the present invention is illuminated in FIG. 1. This embodiment differs from the embodiment of FIGS. 2–5 only in the location of the vertical positioning and stabilization means 25, which is attached to the toe 26 of the putter 20. While attachment to the heel 28 of the putter 20 is preferred, similar results can be obtained with the vertical stabilization means 25 attached, as illustrated, to the toe of most putters.

It should be understood that a variety of circular rollers 40 and different attachment means 44 can be utilized. Specifically, the roller 40 could be made out of plastic or other suitable material. It is, however, necessary that the roller 40 have bearing means 42 on the axle to minimize the rotational friction of the roller, and that the above described relationship between the roller, golf ball and putter head be exact.

Figure 5:
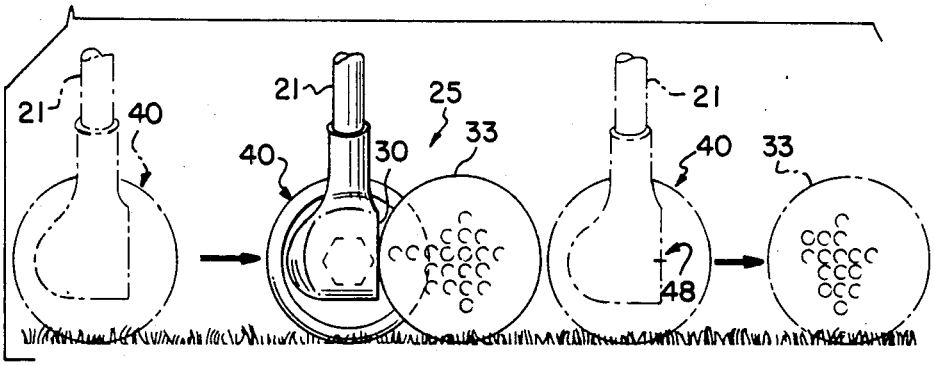
FIG. 5 is a series of progressive front views illustrating the putting stroke of the putter of FIGS. 2–4.

It should be understood that while the vertical positioning and stabilization means 25 has been illustrated as being connected to the putter 20 by drilling and tapping the toe or heel of the putter head, there are numerous other ways to attach the vertical stabilization means to a putter. The most critical aspect of the attachment location of the vertical positioning and stabilization means to the putter is that such connection must insure that the putter "sweet spot" 48 be longitudinally aligned with the center of mass of the ball 33 when the roller 40 is contacting the putting surface 35 at the impact of the putter face with the ball during the putting stroke, as illustrated in FIG. 5. This is most readily accomplished by aligning the axle 44 horizontally with the center of mass of the ball, and then using a roller 40 of the same outer radius as the standard golf ball.

During putting with a putter 20 incorporating the present invention, the golfer addresses the ball 33 in the normal manner. The roller 40 has been selected to allow the golfer to utilize his own natural stance while still insuring that the center of mass of the ball 33 and the "sweet spot" on the face of the putter head coincide.

During the back stroke, to provide for maximum dampening or putter stability, the golfer insures that the roller 40 maintain contact with the putting surface 35 and that the club head 22 be maintained square to the desired direction of travel of the ball. Upon reaching the maximum back stroke that will allow the putter to impart sufficient power to insure that the ball will travel to the hole, the golfer commences his forward stroke, impacts the ball, and follows through, as illustrated in FIG. 5. During this putting stroke, it is preferred that the golfer insure that contact be maintained between the roller 40 and with the surface of the green or other putting surface 35. This should insure that the "sweet spot" 50 on the face of the putter 20 will maintain a constant striking height and be vertically stabilized so that it will impact the ball in line with the ball's center of mass. With the roller 40 in constant contact with the green 35, the golfer can more easily maintain a straight line path to the ball and avoid the "yips". Proper use of the putter 20 utilizing the present invention should maximize the average golfer's putting accuracy.

While it is preferred that the freely rotating roller 40 maintain contact with the putting surface during the entire putting stroke for short putts, it may be necessary for long approach putts that the roller 40, near the end of the back stroke and for a short time into the forward stroke, lose contact with the putting surface. While this condition is undesirable, it is recognized that extremely long putts may require that contact with the putting surface by the roller 40 might be broken. If the duration of the broken contact is brief, advantages of the present invention will most likely not be lost.

For short putts ranging from 3 to 6 feet the present invention is most effective. One golfer's putting experience indicates that the typical weekend golfer can make up to 90% of the 3-foot putts and up to 70% of the 6-foot putts utilizing the present invention properly connected to a conventional putter 20.

FIGS. 6–10 illustrate the application of the invention to a golf club designed for driving a golf ball supported on a tee, and commonly known as a "wood" although the head thereon may be of plastic or other material. The invention may be utilized with any club used primarily to drive a golf ball 33 from an elevated position on a tee 62 above the driving surface 65. However, it should be apparent that application of the present invention to a golf club used to impact a ball on the fairway or in the rough, when the ball is not elevated above the ground, will simply, for obvious reasons, not be advantageous. As with the putter 20, the vertical positioning and stabilization means 25 can be attached to either the toe 64 or the heel 66 of the driver 60, but as with the putter 20, it is preferred that attachment be made to the heel 66.

Figure 10:
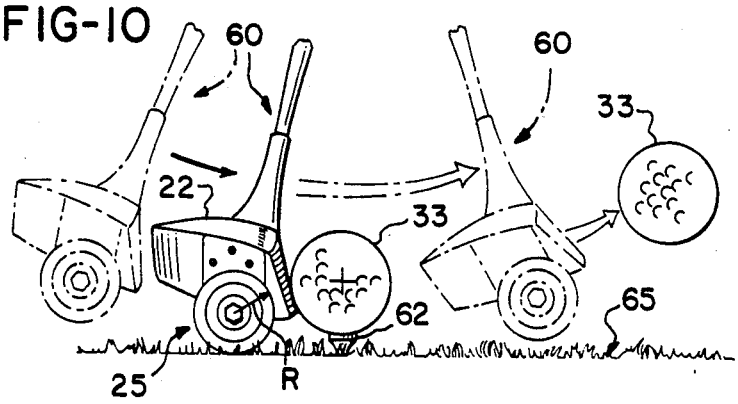
FIG. 10 is a series of progressive front views illustrating the driving stroke of the driver of FIGS. 6 and 7.

When driving a golf ball elevated on a tee, it is important that the center of mass of the club head be aligned at the instant of impact with the center of mass of the ball so that the maximum amount of force will be exerted on the ball, as illustrated in the middle view in FIG. 10. By attaching the positioning and stabilization means 25 to either the heel or the toe of a driving wood 60, the golfer can insure that the driver will be vertically positioned and stabilized and that the "sweet spot" on the face of the club will be aligned with the center of mass of the ball.

The location and construction of the positioning and stabilization means 25 on a driving wood 60 are very similar to those used on the putter 20. Specifically, the vertical positioning and stabilization means 25 consists of a circular roller 70, having bearing means 72 and an axle member 74 connected to the club head by mounting apparatus 75.

As with the putter 20, the axle 74 about which the roller 70 rotates on bearing means 72, is supported by mounting apparatus 75 to the toe or the heel of the driving wood 60, This connection is made such that the extension of an imaginary plane between the toe 64 and heel 66 passes through the "sweet spot" on the club face 77. This imaginary line in conjunction with a vertical imaginary plane through the center of the club face 64 locates the "sweet spot" on the face 64 of the driving wood 60.

Figure 6:
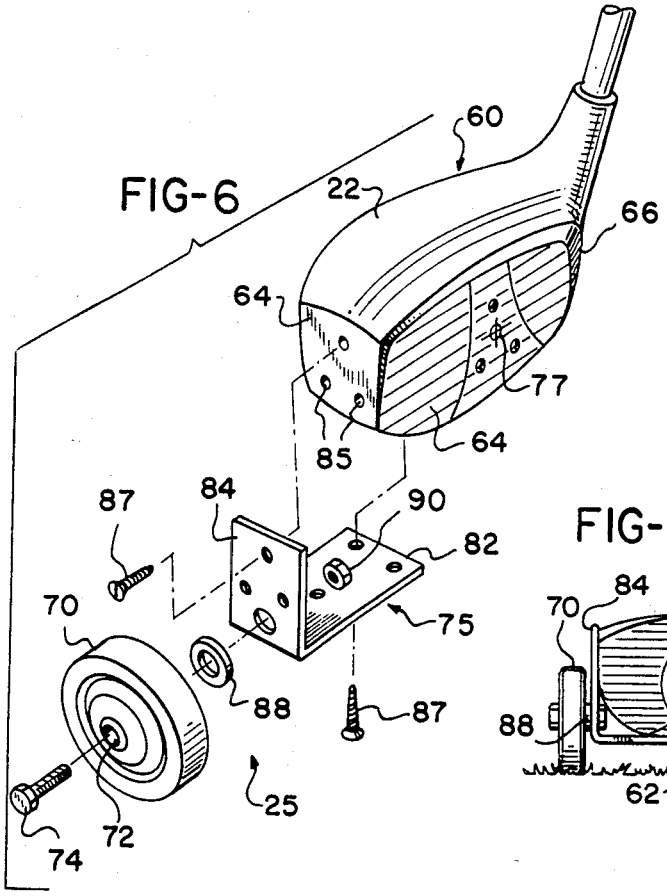
FIG. 6 is an exploded prespective view illustrating application of the present invention to the toe of a driving wood.
Figure 7:
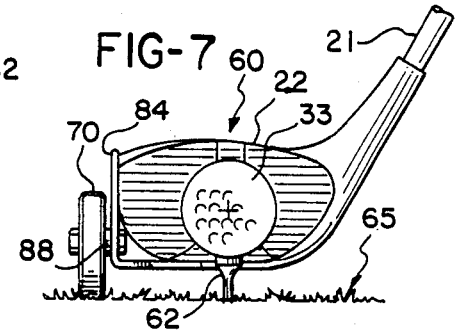
FIG. 7 is a front view illustrating the driving wood of FIG. 6 properly positioned with respect to the golf ball at the moment of impact with the golf ball.
Figure 8:
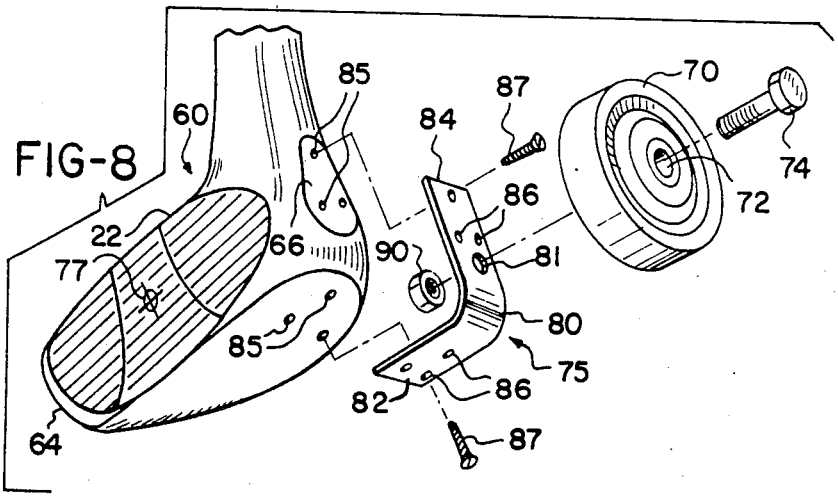
FIG. 8 is an exploded perspective view of the application of the invention to the heel of a driving wood.

As with the putter 20, the radius of the circular roller 70 is selected such that the center of mass of the golf ball mounted on the tee 62 and the most desirable impact point ("sweet spot") on the face of the driving wood 60 coincide. As illustrated in FIGS. 6 and 8, the mounting means 75 consists of an L-shaped bracket 80 having a hole 81 utilized to mount the roller axle 74 on the driving wood 60. One arm 82 of the bracket 80 is attached to the bottom surface of the club head 60, and the other bracket arm 84 is attached to the toe or heel of the club head.

Holes 85 are drilled, and may be tapped, in the bottom and toe or heel of the club head 60 to match holes 86 in bracket 80 and receive attaching screws 87. Roller 70 and its bearing means 72 are assembled on bracker arm 84 and secured thereon by axle 74. Between the second bracket arm 84 and the roller 70 is a spacer 88 which provides a bearing surface between the bracket and roller. Axle 74 is secured to the bracket 80 by nut 90.

Figure 9:
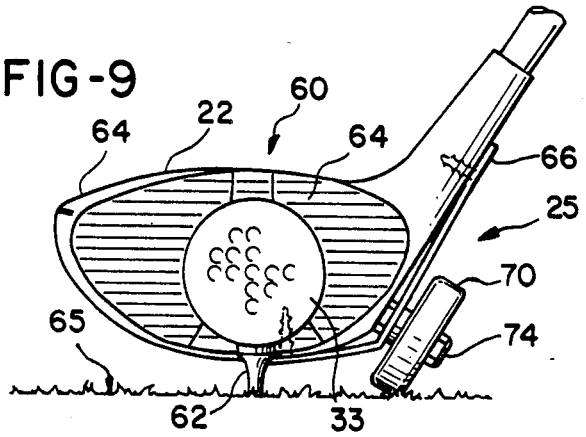
FIG. 9 is a front view illustrating the proper relationship between the driving wood of FIG. 8 and a golf ball at the moment of impact.

As illustrated in FIG. 8, the positioning and stabilization means 25 can also be attached to the heel of the driving wood 60. The heel attachment, as illustrated in FIGS. 8 and 9, may utilize the same basic components and may have the roller 70 oriented at an angle to the ground surface rather than being perpendicular thereto. When the golf ball is mounted on the tee 62, it is critical that the "sweet spot" of the face 64 of the driving wood 22 be aligned at the moment of impact with the center mass of the ball.

During the swing of a driving wood when impacting a golf ball positioned on a tee, it has been deemed important by some authorities that the golfer drag the club head along the ground surface for approximately 16 inches before elevating it above and in back of the golfer in preparation for the downward stroke. The dragging of the club along the ground apparently tends automatically to make the golfer pivot, keep his head steady, keep the swing on plane and insure solid impact.

As the golfer reaches the top of his back swing and commences his down swing, his body shifts, and the club head may have a tendency to strike behind the tee 62. In the absence of the present invention, this would cause the club head to impact the ball below the desired impact point, thus elevating the ball higher than desired and consequently shortening the length and disrupting the accuracy of the drive.

With the positioning and stabilization means 25 installed in the driving wood 60, as the golfer completes his down stroke, he should insure that the roller 70 make contact with the ground surface 65. Once contact is made, the club head will roll along the surface 65 at that predetermined height above the surface 65, and the club face will impact the ball at the desired impact point such that the center mass of the ball and the desired "sweet spot" on the face of the club concide. Thus "skying" and "topping" of the golf ball are greatly reduced, if not totally eliminated.

Additionally, if the golfer makes a concerted effort to insure that his club maintain contact of the roller 70 with the surface 65 for approximately 16 inches during the back swing, he should be reasonably assured that he will maximize his driving distance and accuracy, since the stabilization means 25 will further insure that the preferred "sweet spot" on the face of the club will impact the ball in line with its center of mass.

While the forms of apparatus herein described constitute preferred embodiments of the invention, it is to be understood that the invention is not limited to these precise forms of apparatus, and that changes may be made therein without departing from the scope of the invention which is defined by the appended claims.

What is claimed is:

1. A golf club for striking a golf ball which is supported on or above a relatively smooth playing surface, e.g. on a putting green or on a driving tee, comprising:

(a) a handle, (b) a ball-striking club head mounted at one end of said handle and having toe and heel ends adjacent the opposite ends of a ball-striking face and defining the horizontal axis of said head, (c) said club head having the center of mass thereof located in predetermined aligned vertically and horizontal relation with the center of said face to define the "sweet spot" of said face, (d) a roller having a fixed mounting on one of said club head ends which supports said roller for free rotation with respect to said club head, and (e) the diameter of said roller and the vertical location of said mounting thereof with respect to said club head being so predetermined that when the horizontal axis of said head is in a horizontal position and said roller is in contact with said playing surface at the instant of impart of said club head with a golf ball, the center of mass of said club head and said "sweet spot" are in horizontal alignment with the center of mass of said ball.

2. A golf club as defined in claim 1 wherein said club head is a putting head, said roller is of substantially the same diameter as a standard golf ball, and said mounting thereof positions the rotational axis thereof in substantially horizontal alignment with the center of mass of said club head.

3. A golf club is defined in claim 1 wherein said club head is a driving head, and the diameter of said roller and the vertical location thereof with respect to said club head are so predetermined that said roller extends below the bottom plane of said club head in vertically compensating relation with the height of a ball-supporting tee.

4. A driving golf club as defined in claim 3 wherein said rotatable mounting for said roller includes bracket means secured to one of said ends and the bottom surface of said club head, and axle means mounting said roller on said bracket means.

* * * * *

UNITED STATES PATENT AND TRADEMARK OFFICE

CERTIFICATE OF CORRECTION

PATENT NO. : 4,688,799

DATED : August 25, 1987

INVENTOR(S) : Kenneth W. Johnson

It is certified that error appears in the above-identified patent and that said Letters Patent is hereby corrected as shown below:

Column 1, line 64, "the" , first occurrence, should read -- thus --.

Column 6, line 27, "60," should be --60.--

Column 6, line 30, "line" should be --plane--

Column 6, line 48, "bracker" should be --bracket--

Signed and Sealed this

Twenty-sixth Day of April, 1988

*Attest:*

DONALD J. QUIGG

*Attesting Officer*

*Commissioner of Patents and Trademarks*